US005794289A

United States Patent [19]

Wortman et al.

[11] Patent Number: 5,794,289

[45] Date of Patent: Aug. 18, 1998

[54] MATTRESS FOR RELIEVING PRESSURE ULCERS

[75] Inventors: Ronald D. Wortman, Angola; Michael P. Rechin, Silver Creek; Roland E. Flick, Elma, all of N.Y.; John K. Whitney, Dorado, Puerto Rico

[73] Assignee: Gaymar Industries, Inc., Orchard Park, N.Y.

[21] Appl. No.: 748,209

[22] Filed: Nov. 12, 1996

Related U.S. Application Data

[63] Continuation-in-part of Ser. No. 540,400, Oct. 6, 1995, abandoned.

[51] Int. Cl.[6] ..... A61G 7/04

[52] U.S. Cl. ..... 5/713; 5/714; 5/726; 5/423

[58] Field of Search ..... 5/713, 706, 644, 5/654, 655.3, 932

[56] References Cited

U.S. PATENT DOCUMENTS

| | | | |
|---|---|---|---|
| D. 313,973 | 1/1991 | Walker | D13/168 |
| 3,026,541 | 2/1962 | Murat | 5/81 |
| 3,148,391 | 9/1964 | Whitney | 5/348 |
| 3,644,950 | 2/1972 | Lindsay, Jr. | 5/347 |
| 3,757,366 | 9/1973 | Sacher | 5/423 |
| 3,942,202 | 3/1976 | Chevrolet | 5/449 |
| 3,959,835 | 6/1976 | Nos | 5/706 |
| 4,193,149 | 3/1980 | Welch | 5/713 |
| 4,454,615 | 6/1984 | Whitney | 5/449 |
| 4,542,547 | 9/1985 | Sato | 5/453 |
| 4,686,722 | 8/1987 | Swart | 5/453 |
| 4,711,275 | 12/1987 | Ford et al. | 141/95 |
| 4,873,737 | 10/1989 | Savenije | 5/706 |
| 4,908,895 | 3/1990 | Walker | 5/453 |
| 4,947,500 | 8/1990 | Seiler | 5/713 |
| 4,951,335 | 8/1990 | Eady | 5/709 |
| 4,989,283 | 2/1991 | Krouskop | 5/453 |
| 4,991,244 | 2/1991 | Walker | 5/400 |
| 5,020,176 | 6/1991 | Dotson | 5/453 |
| 5,103,518 | 4/1992 | Gilroy et al. | 5/453 |
| 5,170,522 | 12/1992 | Walker | 5/615 |
| 5,189,742 | 3/1993 | Schild | 5/713 |
| 5,243,723 | 9/1993 | Cotner et al. | 5/453 |
| 5,267,364 | 12/1993 | Volk | 5/453 |
| 5,325,551 | 7/1994 | Tappel et al. | 5/453 |
| 5,388,292 | 2/1995 | Stinson et al. | 5/450 |
| 5,421,044 | 6/1995 | Steensen | 5/713 |
| 5,452,486 | 9/1995 | Czako | 5/81.1 T |

*Primary Examiner*—Kenneth J. Dorner
*Assistant Examiner*—Fredrick Conley
*Attorney, Agent, or Firm*—Hodgson, Russ, Andrews, Woods & Goodyear, LLP

[57] ABSTRACT

A mattress wherein at least one fabric strip bridges a foam crib for an inflatable cushion to provide lateral stability thereto such as when the mattress is tilted for turning a patient over or otherwise. The fabric strip position is selected so as not to interfere with pressure relief to a portion of the patient's body where pressure ulcers frequently occur. In order to accurately and quickly monitor the tilt of a mattress, transmitting and receiving coils are provided on opposite sides of an assembly of lifting bladders for the side of the mattress being lifted, and the signal strength is measured when a signal is transmitted therebetween, and the angle of tilt is determined therefrom. In order to reduce exposure of lines leading to an inflatable mattress, a notch is provided in a crib for receiving a pump for pressurizing a cushion within the crib so that the pump is positioned to face exteriorly of the crib to allow heat dissipation. In order to extend the life of a cubed foam mattress, the mattress comprises at least two identical interchangeable cubed foam sections. In order to effectively provide pressure relief to a person lying on a mattress while preventing bottoming-out when a person sits on the mattress, the mattress is provided with an upper alternating pressure cushion and a lower cushion which allows the pressure in the upper cushion to be reduced and which is of a non-alternating pressure type. Side-by-side bladders are provided between upper and lower side-by-side cushions respectively for inclining the mattress. Hip bladders are provided to apply pressure to the hip area of a person lying on the mattress on a side opposite to the side of the mattress being inclined in order to maintain body alignment.

24 Claims, 10 Drawing Sheets

FIG. 2
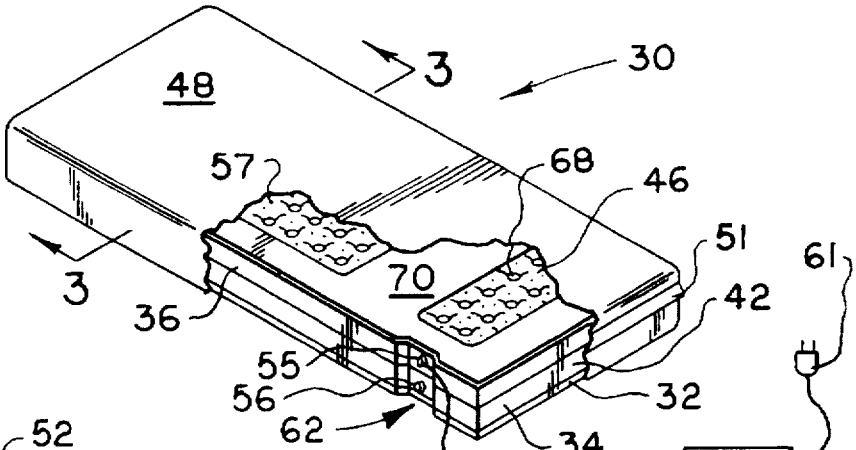
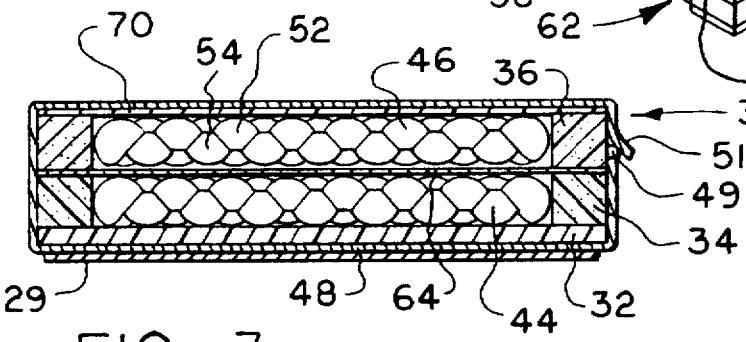
FIG. 3
FIG. 6
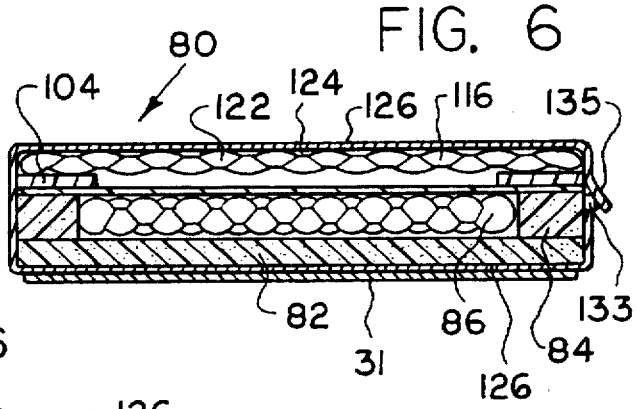
FIG. 5
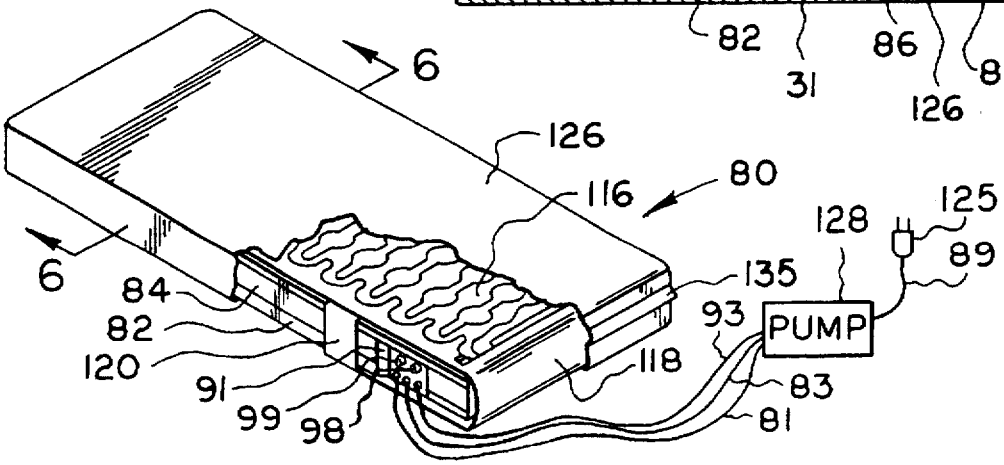

FIG. 8
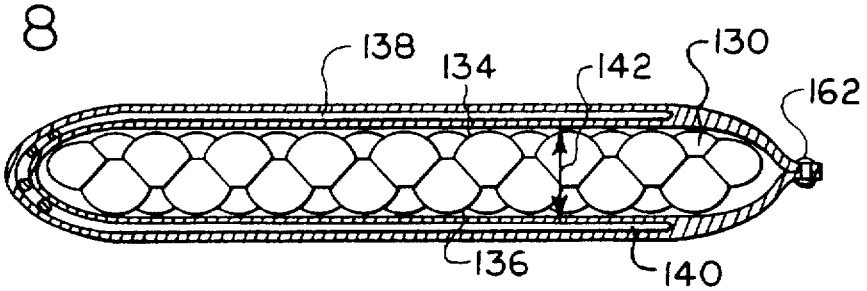
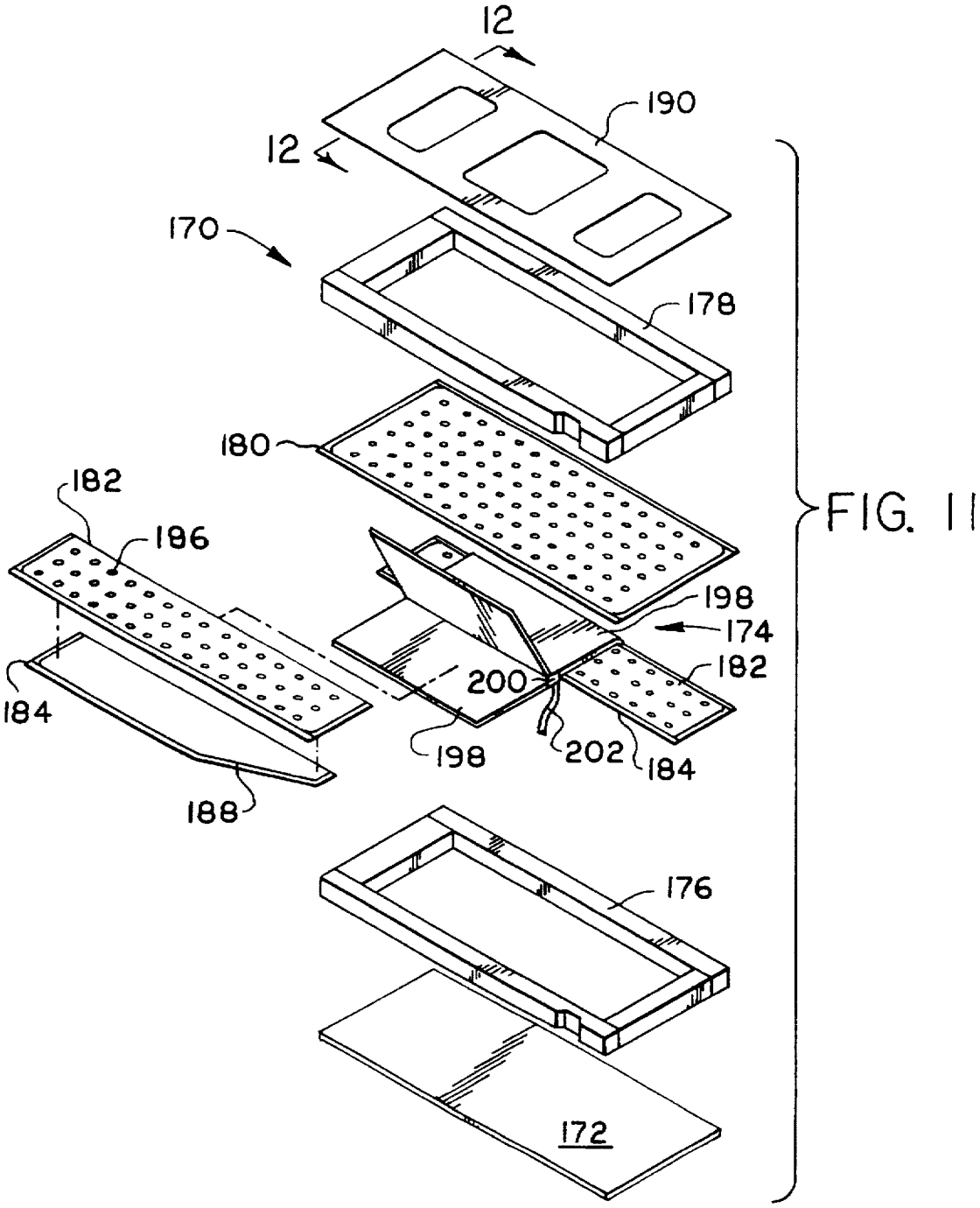

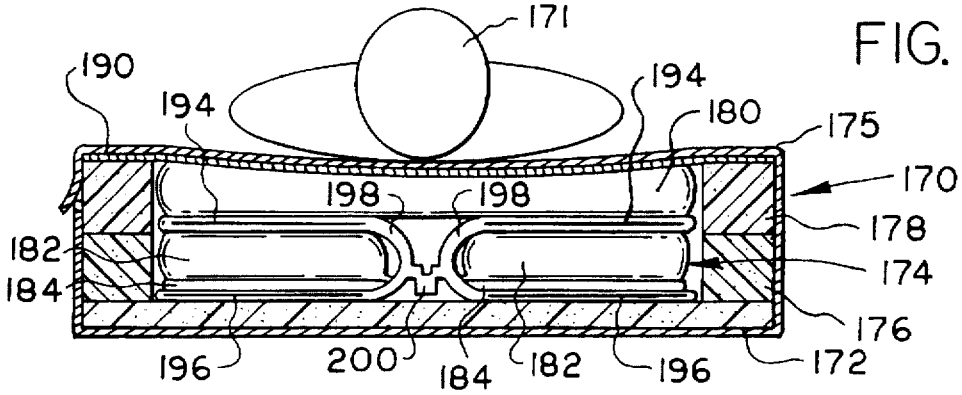
FIG. 12
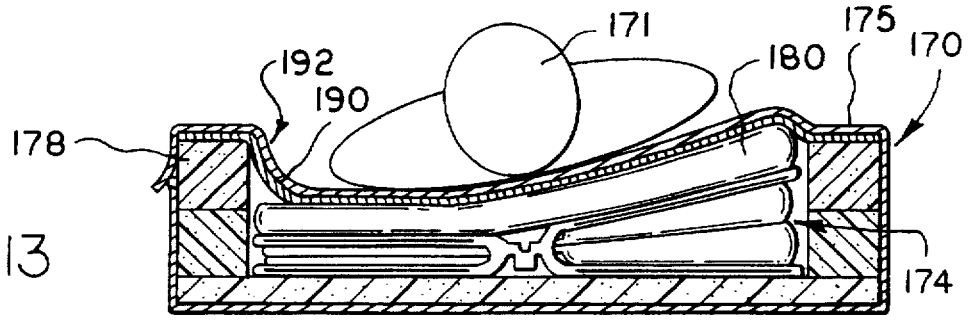
FIG. 13
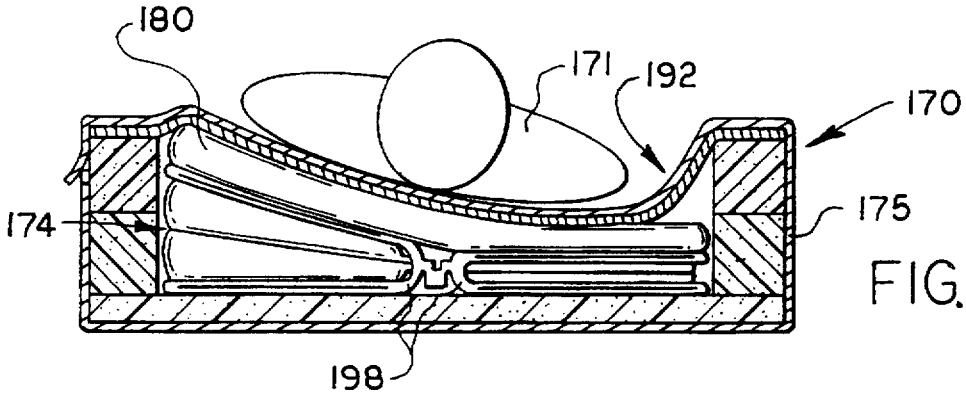
FIG. 14
FIG. 24
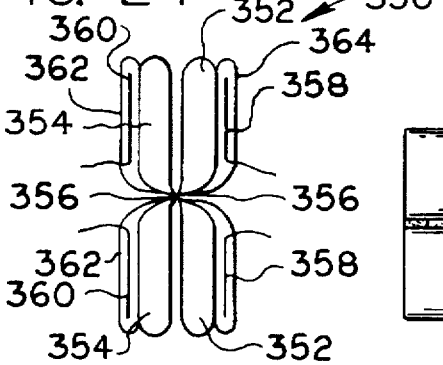
FIG. 23
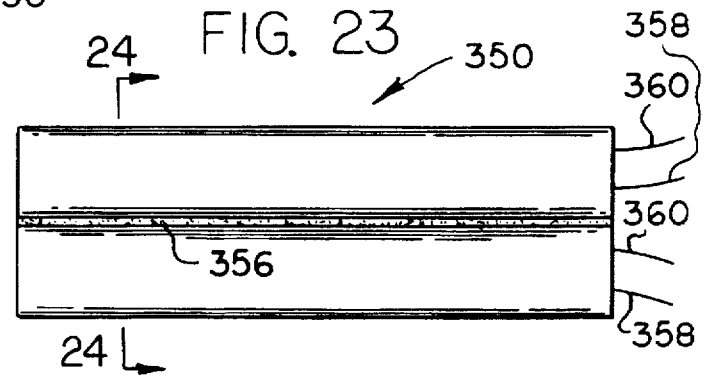

FIG. 15
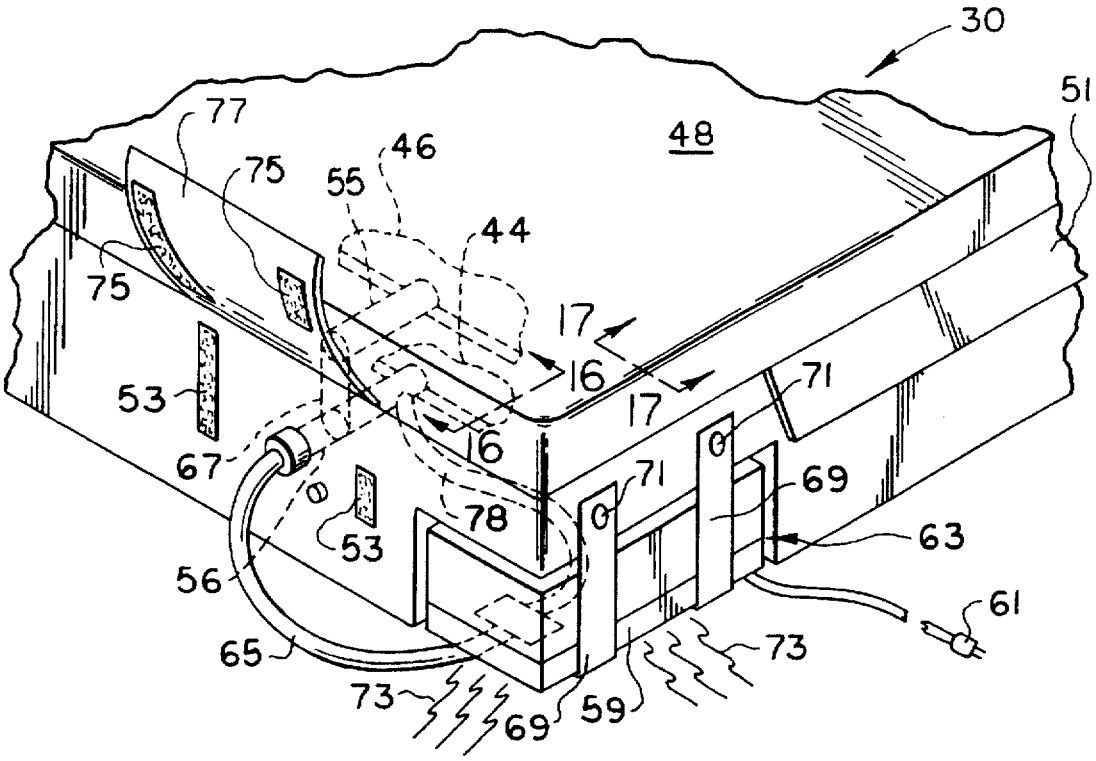
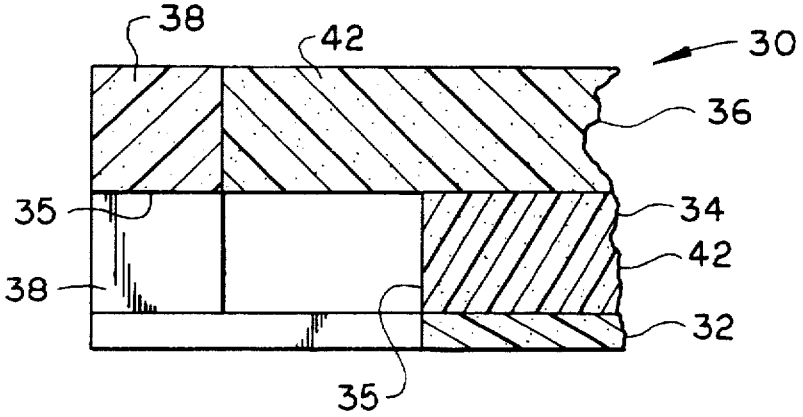
FIG. 16
FIG. 17
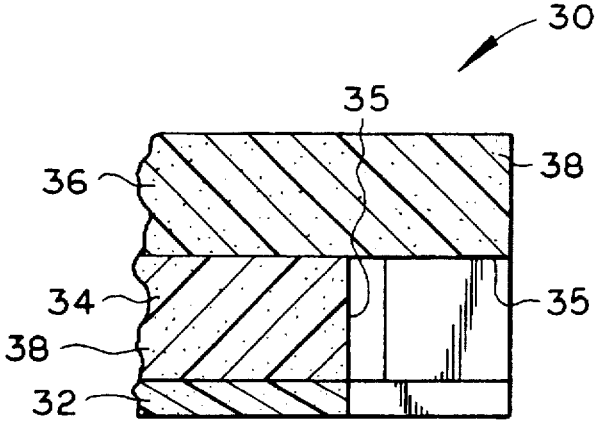

FIG. 25
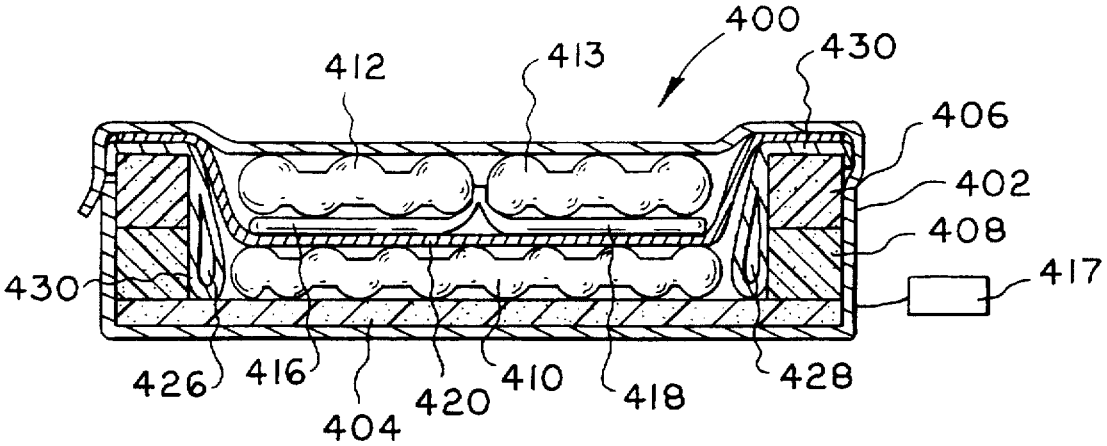
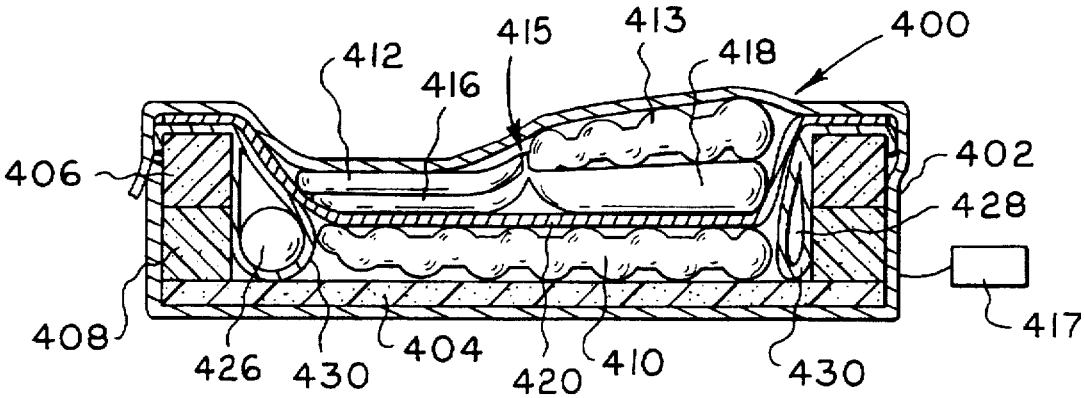
FIG. 26
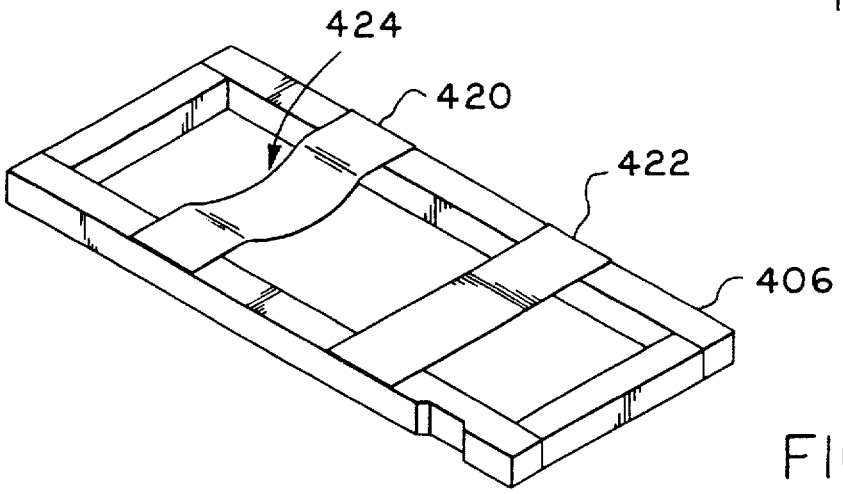
FIG. 27

MATTRESS FOR RELIEVING PRESSURE ULCERS

This application is a continuation-in-part of application Ser. No. 08/540,400, filed Oct. 6, 1995, now abandoned, the disclosure of which is hereby incorporated herein by reference.

The present invention relates generally to mattresses, i.e., two or more components contained as a unit within a mattress cover. More particularly, the present invention relates to mattresses in which are contained air-pressurized cushions in order to provide pressure relief to patients or the like in a hospital or home setting so that the development of pressure ulcers may be prevented or retarded. Features of the present invention also relate to foam mattresses.

Gaymar Industries, Inc. of Orchard Park, N.Y., the assignee of the present invention, provides a pressurized cushion known as Sof-Care Plus long-term bed cushion (Gaymar model SC-427) for pressure relief. This cushion, which has been supported by a conventional non-pressurized mattress for use, has a multitude of lower individual air chambers and a multitude of upper individual air chambers with air transfer channels therebetween. Air is transferred through the interconnecting channels to redistribute the patient's weight over the entire bed cushion. A three-layer cushion known as Sof-Care II cushion (Gaymar model SC-440) continually redistributes patient weight through 300 air-filled chambers and has hand grips at the side of the cushion to assist in patient positioning. In these types of cushions, the individual air chambers remain pressurized. Thus, these cushions are of a non-alternating pressurized type.

Gaymar Industries, Inc. also provides a pad or cushion (model PAF-350) and pump (model AFP-355) combination known as Airflo Plus alternating pressure system. In this system, alternate air chambers are alternately inflated and deflated to relieve excess pressure on patients at risk of developing or having pressure ulcers. Micro vents are provided to produce a gentle flow of air beneath the patient to help minimize moisture build-up. Such a system is described in U.S. Pat. No. 3,148,391 to Whitney, which is incorporated herein by reference. Other art showing alternating pressure pads or cushions includes U.S. Pat. No. 5,243,723 to Cotner et al, U.S. Pat. No. 5,103,518 to Gilroy et al, U.S. Pat. No. 2,998,817 to Armstrong, and U.S. Pat. No. 1,772,310 to Hart, which are also incorporated herein by reference.

Other art which may be of interest to the present invention includes U.S. Pat. Nos. 3,026,541; 3,644,950; 3,757,366; 3,942,202; 4,193,149; 4,454,615; 4,542,547; 4,686,722; 4,711,275; 4,873,737; 4,908,895; 4,947,500; 4,951,335; 4,989,283; 4,991,244; 5,020,176; 5,170,522; 5,189,742; 5,267,364; 5,325,551; 5,388,292; 5,452,486; and DES.313,973.

A mattress is defined herein, for the purposes of this specification and the claims, as two or more components contained as a unit within a mattress cover or other means holding the components together for providing support to a person lying thereon. Thus, a mattress should be distinguished from a cushion overlay used as a supplemental pad on top of a mattress, as shown in U.S. Pat. No. 4,454,615 to Whitney. However, a mattress in accordance with the present invention may contain a cushion overlay and another cushion.

By utilizing upper and lower air cushions in a mattress, the pressure in the upper air cushion may be desirably reduced while achieving the desired pressure relief. However, a non-stretchable mattress cover in which the cushions are contained may undesirably exhibit a "hammocking" effect and thereby interfere with the effectiveness of an upper alternating pressure cushion in providing the desired pressure relief. Elastomeric mattress covers have been suggested for minimizing this "hammocking" effect.

When one or more cushions of the alternating pressure type are provided in a mattress, such as shown in Cotner et al, there may not be adequate support when a patient is, for example, sitting on the mattress with the result that the portion of the mattress being sat on may bottom out.

U.S. Pat. No. 5,325,551 to Tappel et al, which is incorporated herein by reference, discloses a mattress for retarding development of decubitus ulcers. Included within a fabric cover is a foam bottom sheet upon the opposite side edges of which rests two foam side elements which extend approximately three-quarters of the way toward the foot end. A head end foam element rests on the head end edge portion of the bottom sheet. An inflatable air bladder rests on the bottom sheet between the side elements and engages the head end element. The vertical thickness of the air bladder is substantially equal to the vertical thicknesses of the side and head end elements. The end of the bladder remote from its head end is approximately flushly aligned with the ends of the side elements. A control unit including a pressurized air pump is mounted on the foot end portion of the bottom sheet between the bladder and the foot end, and upper and lower foot end foam elements are provided with cut-outs to accommodate the control unit. A pair of foam top sheets overlie the side elements, bladder, and head and foot end elements.

While the placement of the pump thusly so that it is enclosed by the foam elements desirably alleviates the necessity of running lines from a separate pump for connection to a mattress unit, such an internal placement of the pump may not suitably allow heat dissipation with the result that heat may undesirably build-up within the mattress element. Such an internally disposed pump may also be difficult to replace.

U.S. Pat. No. 5,388,292 to Stinson et al discloses a mattress for avoiding pressure ulcers which comprises a foam support with a bottom and sides that define a cavity adapted to accommodate a plurality of water-filled bladders, one at the foot, one at the head end, and one in the middle. The bladders are removably attached to each other to allow ease in transport and storage without draining. The bladders and foam inlay are enclosed by a pair of covers.

Also disclosed in Stinson et al is an air flotation system which comprises a multiplicity of elongate bladders within a foam inlay with top and bottom foam sections forming an envelope for the bladders. The multiplicity of bladders are arranged in three layers vertically with a multiplicity of bladders in the middle layer extending in a direction which is perpendicular to the direction in which multiplicities of bladders in the upper and lower layers extend so that a crisscrossing of bladders is provided. Foam layers are placed between the bladder layers. Foam portions are alternatively shown to extend along the side edges to form the inlay.

U.S. Pat. No. 4,947,500 to Seiler discloses a therapeutic mattress for preventing or curing decubitus ulcers which comprises a foamy base layer on which rests an elastic frame layer composed of upper and lower foam strips mutually glued together. Inside this assembly is disposed a core of a pair of side-by-side head end air cushions, a pair of side-by-side foot end air cushions, and a pair of side-by-side air cushions therebetween. A soft foam insert rests on each pair of air cushions, and a foam cover layer extends over the entire upper surface of the mattress. The cover layer is connected to the frame layer at discrete locations to make the mattress form a unitary whole. The pairs of air cushions are held apart from other pairs thereof by foam transverse straps which rest on the base layer.

Egerton of America of Jacksonville, Fla. provides a pressure-relief inflatable mattress, called The Paragon Portable, having side support chambers which it claims provides "a firmer edge to the mattress, giving support when getting on and off or when turning on the surface."

Thus, there is a need in the art to stabilize the side edges of inflatable mattresses to provide the desired firmness when a patient sits on the side of the bed. Thick foam members overlying inflatable cushions may unduly interfere with the pressure relief effectiveness of the cushions as well as unduly add to the cost of mattress production.

It is also considered desirable to be able to more easily roll a patient over or cause the patient to sit up on the edge of the bed.

A mattress cushion is desirably inflated until the patient "lifts-off" the bottom and is thus supported by air in the cushion. Conventionally, this has been verified by a "hand-check" wherein the hand is placed, palm up, under the mattress beneath the patient's bony prominence. When the patient's bony prominence cannot be felt, it was concluded that the cushion was adequately inflated. This process does not lend itself well to "adjustment" of cushion pressure. If the patient is adjusted or moves on the mattress, the cushion pressure may not be adequate to keep the patient supported. Thus, the "hand check" method must be continually repeated to verify proper patient support.

Hart discloses devices for raising one side of a bed relative to the other for turning a patient over. The turning devices consist of inflatable or deflatable bags or cells located on opposite sides of the longitudinal center of the mattress and between the mattress and the supporting base of the bedstead.

U.S. Pat. No. 4,873,737 to Savenile, which is hereby incorporated herein by reference, discloses a fluid-filled mattress with height measuring and control devices which allows more accurate electronic measurements indicative of whether the patient is properly supported and thus allows the cushion support to be at the optimum pressure. The electronic device measures the distance between the top and bottom faces of the cushion.

It is also considered desirable to be able, when a mattress is rotated or tilted so that the patient may more easily be rolled over or caused to sit up, to be able to accurately and quickly monitor the amount of tilt.

During tilting of the mattress, the patient may bear against a foam crib portion on the lower side of the mattress. In this circumstance, it is considered especially desirable that the side crib portion be laterally stabilized.

Gaymar Industries, Inc. has provided what has been called the Top Guard II Plus foam mattress in which the upper portion is "cubed" by providing crisscrossing channels in the upper surface so that individual body portions may be supported individually. It has been found that some sections of this mattress wear out faster than other sections thereby reducing the mattress life.

SUMMARY OF THE INVENTION

It is accordingly an object of the present invention to provide an effective, low-cost, user-friendly mattress for providing pressure relief to a patient.

It is another object of the present invention to adequately support a person sitting on a mattress having a cushion of an alternating pressure type so that the mattress is restrained from bottoming out.

It is a further object of the present invention to inexpensively and effectively laterally stabilize a foam crib for an inflatable air cushion mattress without unduly interfering with the pressure-relieving effectiveness of the air cushion.

It is yet another object of the present invention to accurately and quickly monitor the tilt of a mattress for rolling a patient over or sitting the patient up.

It is a still further object of the present invention to eliminate exposure of lines between the air pump and air cushion without trapping heat from the pump within the mattress so that heat build-up is avoided.

It is another object of the present invention to provide the air pump to be easily replaceable and user friendly.

It is yet another object of the present invention to extend the life of "cubed" foam mattresses.

In order to effectively transmit pressure relief to a person lying on a mattress, in accordance with the present invention, the mattress is provided with an upper alternating pressure cushion and a lower cushion which allows the pressure in the upper cushion to be reduced, the lower cushion being a cushion of the non-alternating pressure type.

In order to provide lateral stability to a pressurizable mattress having an inflatable cushion within a foam crib, in accordance with the present invention a fabric strip is provided to extend between and is attached to elongate crib portions which extend alongside the cushion sides.

In order to accurately and quickly monitor the tilt of a mattress, in accordance with the present invention, a signal transmitting coil is provided on one wall of a bladder for lifting one side of the mattress, a signal receiving coil is provided on the opposite wall of the bladder, and the signal strength is measured when a signal is transmitted between the coils to determine the distance therebetween, and the angle of tilt is determined therefrom.

In order to eliminate exposure of lines between the air pump and air cushion without trapping heat from the pump within the mattress so that heat build-up is avoided, in accordance with the present invention a notch is provided in the crib for receiving the pump so that the pump is user-friendly, easily replaceable, and positioned to face exteriorly of the crib for release of heat exteriorly of the crib.

In order to extend the life of a "cubed" foam mattress, in accordance with the present invention the mattress is provided to comprise at least two interchangeable "cubed" foam sections.

The above and other objects, features, and advantages of the present invention will be apparent in the following detailed description of the preferred embodiments thereof taken in conjunction with the accompanying drawings wherein the same reference numerals denote the same or similar parts throughout the several views.

BRIEF DESCRIPTION OF THE DRAWINGS

FIG. 2 is a perspective view thereof with a portion of the mattress cover broken away for ease of illustration.

FIG. 3 is a sectional view thereof taken along lines 3—3 of FIG. 2.

FIG. 5 is a perspective view of the mattress of FIG. 4 with a portion of the mattress cover broken away for ease of illustration.

FIG. 6 is a sectional view of the mattress of FIG. 5 taken along lines 6—6 thereof.

FIG. 8 is a sectional view of the cushion taken along lines 8—8 thereof.

FIG. 11 is a view similar to that of FIG. 1 illustrating a mattress containing the cushion of FIGS. 7 and 8 on each side of the longitudinal centerline thereof.

FIG. 12 is a sectional view of the mattress of FIG. 11 taken along lines 12—12 thereof and illustrating the cushion of FIGS. 7 and 8 an untilted condition.

FIG. 13 is a view similar to that of FIG. 12 of the mattress of FIG. 11 and illustrating the cushion of FIGS. 7 and 8 tilted to one side.

FIG. 14 is a view similar to that of FIG. 12 of the mattress of FIG. 11 and illustrating the cushion of FIGS. 7 and 8 tilted to the other side.

FIG. 15 is a perspective view of a portion of the mattress of FIG. 1 and illustrating installation of an air pump in accordance with another embodiment of the present invention.

FIG. 16 is a partial sectional view of the mattress portion of FIG. 15 taken along lines 16—16 thereof with the air pump removed ease of illustration.

FIG. 17 is a partial sectional view of the mattress portion of FIG. 15 taken along lines 17—17 thereof with the air pump removed for ease of illustration.

FIG. 23 is a schematic plan view of an alternative embodiment of the lifting assembly of FIGS. 7 to 14.

FIG. 24 is a schematic sectional view thereof taken along lines 24—24 of FIG. 23.

FIG. 25 is a view similar to that of FIG. 12 illustrating an alternative embodiment of a mattress having a tilting bladder and in an untilted condition.

FIG. 26 is a view similar to that of FIG. 12 illustrating the mattress of FIG. 25 in a tilted condition.

FIG. 27 is a perspective view of the upper crib for the mattress of FIGS. 25 and 26.

DETAILED DESCRIPTION OF THE PREFERRED EMBODIMENTS

Figure 1:
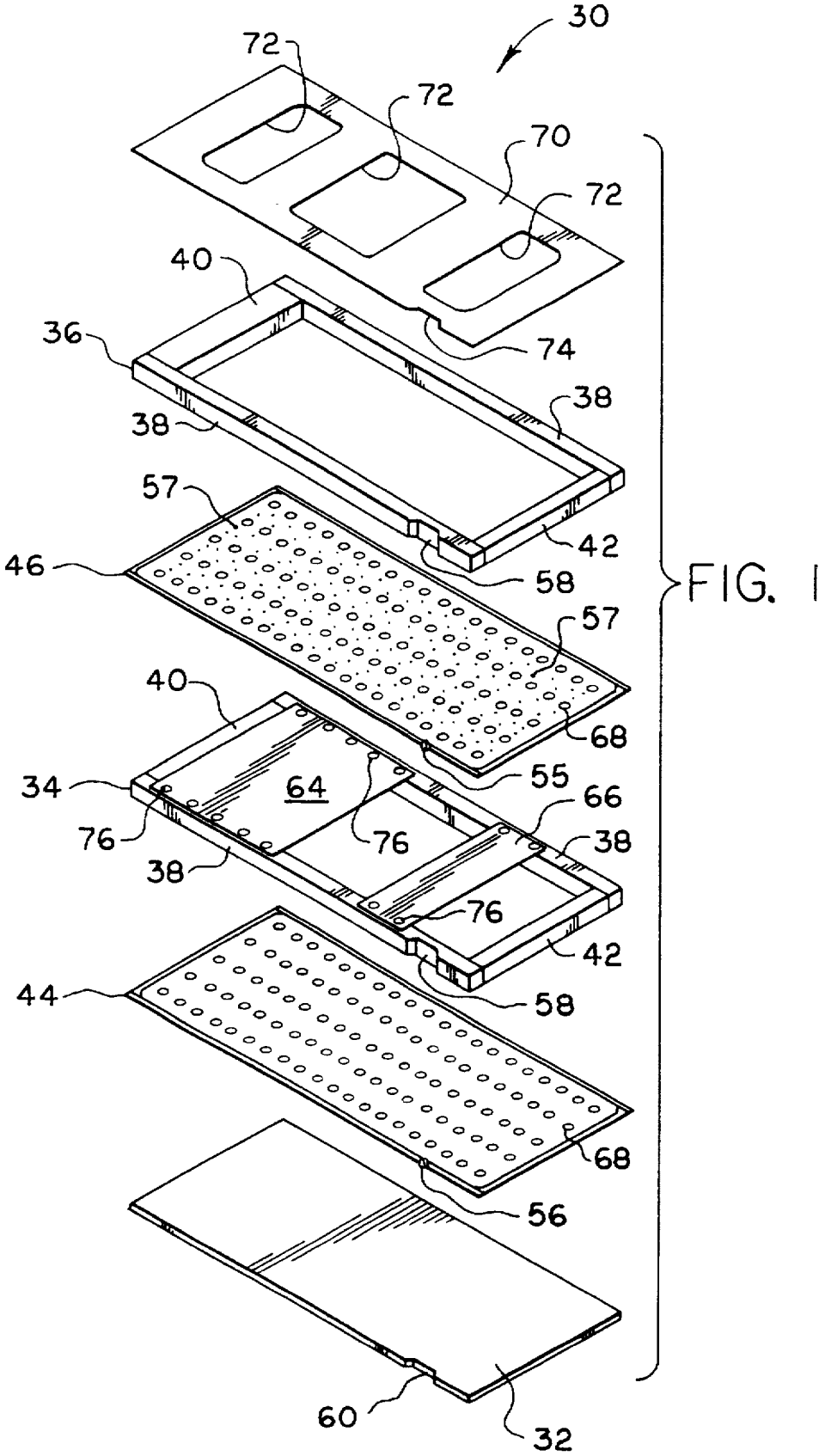
FIG. 1 is an exploded view, with the mattress cover removed, of one embodiment of a mattress in accordance with the present invention.

Referring to FIGS. 1, 2, 3, there is shown generally at 30 a pressurized mattress for use in providing pressure relief to patients with or at risk of pressure ulcers. The mattress 30 is rectangular and is of twin-bed size or may be otherwise suitably shaped and sized.

The mattress 30 includes a foam bottom support member 32 which may have a thickness of, for example, perhaps about 1 inch. Member 32 supports along its perimeter a crib 34 which in turn supports another crib 36. The cribs 34 and 36 and support 32 are adhesively or otherwise suitably attached.

Cribs 34 and 36 are also composed of a foam material. Each of the cribs 34 and 36 includes a pair of relatively long elongate portions or members 38 extending along sides of the mattress and a pair of relatively short elongate portions or members 40 and 42 extending along the head and foot ends respectively of the mattress. Each of the members 38 and 42 may have a size in cross-section of, for example, perhaps about 3½ inches by 3½ inches. The head end member 40 has an increased width so that it may have a size in cross-section of, for example, perhaps about 7 inches by 3½ inches. The ends of members 40 and 42 are adhesively or otherwise suitably attached to the ends respectively of members 38. Alternatively, each of the cribs 34 and 36 may be formed as a single piece.

The cribs 34 and 36 define a framework in which are received lower and upper air cells 44 and 46 respectively to rest on support member 32. The air cells or cushions 44 and 46 are pressurized to support a patient. The entire assembly is enclosed within a cloth mattress cover 48 which may suitably have a zipper, illustrated at 49, which is suitably covered by a cover flap 51, to extend partially around the perimeter of the mattress to allow the assembly to be placed therein and removed therefrom.

Each of the cushions 44 and 46, shown uninflated in FIG. 1, is composed of a suitable puncture-resistant vinyl film or other suitable air imperious flexible material and is of a type which has a multiplicity of perhaps 150 upper air cushion cells 52 which partially overlap vertically a multiplicity of perhaps 150 lower air cushion cells 54. The upper and lower layers of a cushion are welded together at button welds, illustrated at 68, to prevent ballooning of the cushion. The cushions may each have a height when inflated of perhaps about 3½ inches. An example of such a cushion is the previously discussed Sof-Care Plus long-term bed cushion of Gaymar Industries, Inc. The lower cushion 44 may be inflated to a suitable pressure by means of a manual inflator connectable to air inlet, illustrated at 56, for pressure communication with the cushion 44. The upper cushion 46 is of a type which has a multiplicity of pin holes of micro-vents, illustrated at 57, in its upper layer to produce a gentle flow of air beneath the patient and to minimize moisture build-up. A suitable electric air pump, illustrated at 59, having an electrical plug 61 is provided for automatically maintaining a desired pressure in the upper cushion 46. The pump 59 has an air outlet hose 65 which is suitably connected to air inlet 55 to the upper cushion 46. A passage, illustrated schematically at 67 in FIG. 15, is provided internally of the crib structure between the air inlets 56 and 55 for the air cells 44 and 46 for supplying pressurizing air to the lower air cell 44. Air transfer channels (not shown) between the cells 52 and 54 allow air to transfer therebetween to redistribute the patient's weight over the entire cushion. Such a cushion called the Sof-Care Plus long-term bed cushion (catalog No. SC-427) and an inflator called the Sof-Care Inflator (catalog No. SC-505) are marketed by Gaymar Industries, Inc. Pump 59 may have a size of, for example, about 4⅝ inches wide, 4 inches high, and 9⅛ inches long. A suitable pump for cushion 46 may, for example, be a powered air loss pump (model PAL510 or 511) also marketed by Gaymar Industries, Inc. It should however be understood that any other suitable cushions and pressurization means (such as the Airflo Plus Pump model AFP-355 or AFP-45 also marketed by Gaymar Industries, Inc.) may be provided, and such other cushions and pressurization means are meant to come within the scope of the present invention.

Each of the cribs 34 and 36 has a cut-out, illustrated at 58, in one of the side members 38 adjacent the foot end, and the support member 32 has a corresponding cut-out, illustrated at 60. The cut-outs 58 and 60 together define a recess, illustrated generally at 62 in FIG. 2, for providing suitable space for the pump and inflator connections to air inlets 55 and 56 which pass through the resulting reduced thickness portions of the side members 38.

In order to stabilize the cribs so as to prevent the side members 38 from bowing or pulling outwardly when a patient sits on the side of the bed, in accordance with the present invention fabric strips or webs composed of non-woven nylon or other suitably strong fabric material are provided to extend between and are bonded or otherwise suitably attached to the side members 38. Thus, the fabric strips bridge over the cushion from one of the side members 38 to the other. The thinness of the fabric strips (perhaps less than about 0.1 inch thick) minimizes interference with the effectiveness of the cushions in relieving pressure.

The locations of the fabric strips are selected so that they do not unduly interfere with pressure relief to critical body areas such as the heels, buttocks, and shoulders where pressure ulcers mainly occur. The fabric strips are positioned in areas such as the middle of the back and thighs where pressure ulcers seldom occur. Thus FIG. 1 shows two fabric strips 64 and 66 for the lower crib 34. One fabric strip 64 extends across the head end and extends along about one-third of the mattress length to support the shoulders to prevent potential choking and to provide a transition bridge when CPR deflation is required. A narrower fabric strip 66 is provided intermediate the fabric strip 64 and the foot end. For example, fabric strips 64 and 66 may have widths of perhaps about 30 and 10 inches respectively for a mattress 30 having a length of perhaps about 6 feet 8 inches and a width of perhaps about 3 feet. Fabric strip 64 is also bonded or otherwise suitably attached to head end member 40. FIG. 1 shows a single fabric strip 70 for the upper crib 36, this fabric strip extending over the length of the mattress and having cut-outs, illustrated at 72. Cut-outs 72 may be placed to correspond to the hip, shoulder, and feet areas to allow more direct patient contact with the cushions in those areas where pressure ulcers may mainly occur. Fabric strip 70 has a cut-out 74 in its side edge which corresponds to cut-outs 58 and 60. Thus, the areas covered by the fabric strips are minimized and their locations selected so that the benefits provided by the cushions 44 and 46 may be maximized.

Each of the edge portions of fabric strips 64 and 66 which are bonded to the side members 38 of the lower crib 34 has a plurality of apertures, illustrated at 76, therein to provide bonding of the upper crib to the lower crib through the apertures 76 for enhanced integrity of the mattress.

Figure 4:
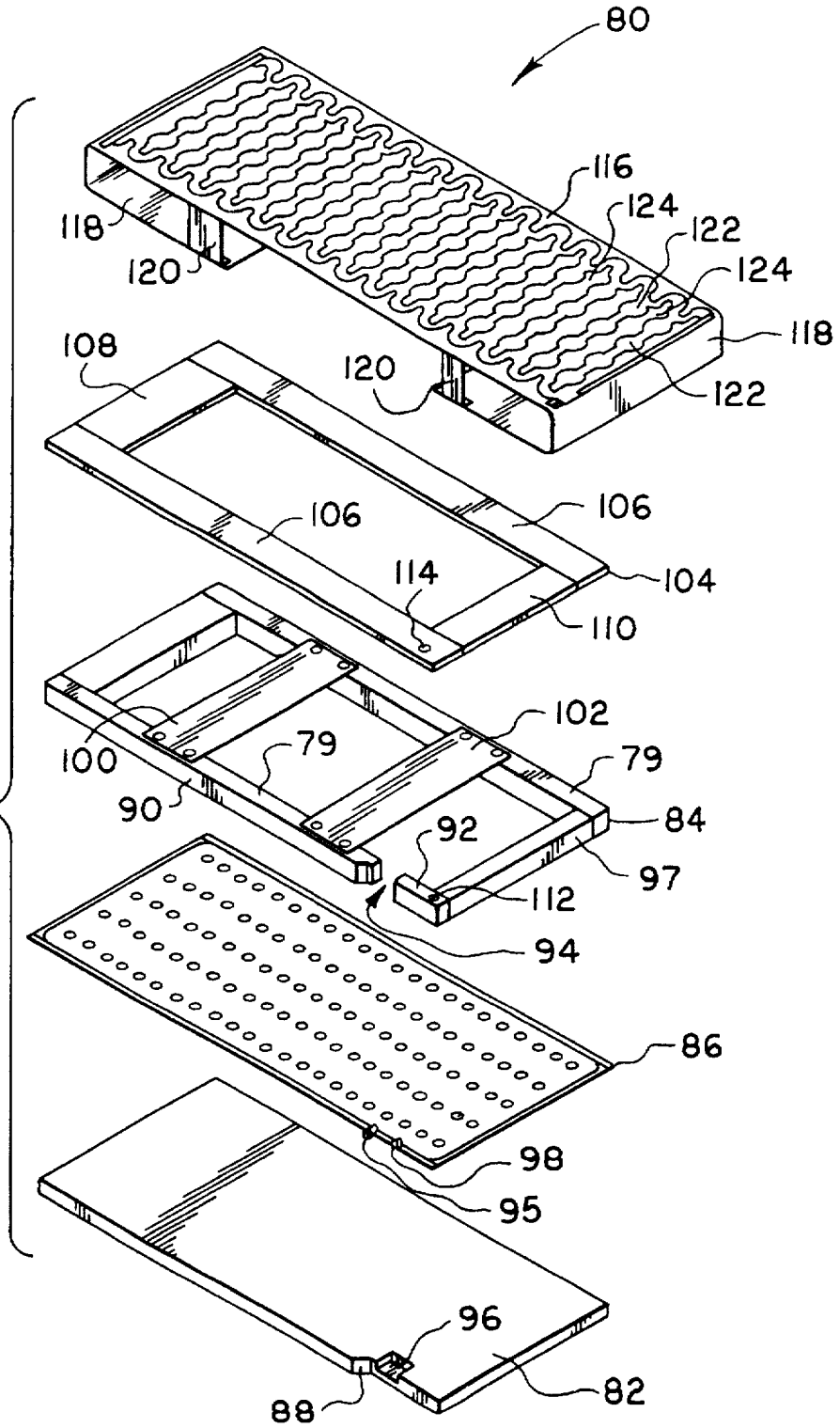
FIG. 4 is a view similar to that of FIG. 1 of an alternative embodiment of the mattress.

Referring to FIGS. 4, 5, and 6, there is shown generally at 80 an alternative embodiment of the mattress having a foam support member 82, crib 84, and lower cushion 86 which are similar to support 32, crib 34, and cushion 44. Instead of recess 62, support member 82 has a cut-out 88 in a corner which provides a reduced width in the foot end portion thereof and an associated indent, illustrated at 96, in its upper surface, and the corresponding side member 79 of crib 84 comprises two portions 90 and 92 in end-to-end relation which are spaced apart to define an opening or entrance, illustrated at 94, for installation of a pump control panel 91. A CPR dump valve, which allows quick deflation in an emergency, is illustrated at 98. A pressure control knob, illustrated at 99, is provided for control of pressure to the lower cushion, the pressure in the upper cushion being controlled by means of a check valve (not shown) between the cushions. Crib 84 has two fabric strips 100 and 102, similar to fabric strips 64 and 66, for laterally stabilizing the mattress 80. Each fabric strip 100 and 102 has a width of perhaps about 10 inches. Fabric strips 100 and 102 are spaced from the head and foot ends respectively a distance of perhaps about 17 and 20 inches respectively and from each other a distance of perhaps about 21 inches.

Illustrated at 104 is a frame member composed of a foam material having a thickness of perhaps about 1 inch and having a pair of relatively long side portions 106 and relatively short head and foot portions 108 and 110 respectively bonded or otherwise suitably attached together. The head end portion 108 may have a width of perhaps about 14 inches. Portions 106 and 110 may have widths of perhaps about 6 inches. Holes, illustrated at 112 and 114, in the crib 84 and frame member 104 respectively are provided to pass hoses.

The frame member 104 supports a cushion 116 to the head and foot ends of which are attached end flaps 118 of a suitable cloth which wrap around to underlie the head and foot portions respectively of frame member 104, crib 84, and support member 82. The outer edges of the end flaps 118 are held in position by strips 120 of cloth which are attached to and extend between the respective outer or terminal edge portions of the end flaps 118 and the edge of the undersurface of the cushion 116.

The cushion 116 is of an alternating pressure type, i.e., it has at least two series of alternating cells, such as alternating cell rows illustrated at 122 and 124, which are alternately inflated and deflated, one series of cells being inflated while the other series of cells is deflated. The cell rows 122 and 124 are pressurized by pump 128 via air hoses 81 and 83 respectively connected to air inlet nipples 85 and 87 respectively thereto to alternately inflate and deflate to continuously relieve excess pressure on the patient while creating a massaging motion for extra comfort. Pump 128 has a power supply line 89 having plug 125. A suitable cushion 116 is the previously discussed Airflo Plus pad model PAF-350, and a suitable pump therefor is the Airflo Plus pump model AFP-277, AFP-377, or AFP-355, both the cushion and pump marketed by Gaymar Industries, Inc. Such a cushion and a suitable pump therefor are described in greater detail in the aforesaid Whitney patent. The cushion 116 may of course be pressurized by any other suitable pump.

The cushion 86 is disposed beneath the cushion 116 so that the pressure in cushion 116 may be lowered from perhaps 80 to 30 mm Hg to improve the level of comfort while maintaining pressure relief. In order to prevent bottoming out of the mattress 80 when a person sits on it, the cushion 86 is of a type wherein all or virtually all of its air cells remain inflated, i.e., a non-alternating pressure type cushion. Cushion 86 is pressurized by air outlet hose 93 from the pump 128 which is connected to air inlet nipple 95. While the lower cushion 86 is preferably of a pressurized type, it should be understood that it may be any other suitable cushion such as foam which receives part of the load of a person lying on the mattress to substantially reduce the upper cushion pressure required for supporting the person.

The support members 82 and 104 and crib 84 are suitably bonded together and the assembly containing cushions 86 and 116 are enclosed in a zippered mattress cover 126 having zipper 133 and zipper cover flap 135. A typical cloth mattress cover may exhibit a "hammocking" effect thereby inhibiting the transmission of pressure relief from the upper cushion to a person lying on the mattress. In order to minimize this "hammocking" effect, in accordance with the present invention, the mattress cover 126 is composed of an elastomeric material which stretches in all directions to conform to the upper surface of the upper cushion 116 when a person lies thereon. For example, the mattress cover 126 may be suitably composed of a weft knitted nylon 66 fabric which has an elastomeric polyurethane transfer coating to be water-repellent, such as sold by Penn Nyla of Nottingham, England and identified as Dartex P072, P171, or P272.

The mattresses 30 and 80 are each shown to have two cushions. The provision of two cushions in a mattress may be necessary in order to achieve a certain height such as at least five inches in order to comply with certain rules. However, it is to be understood that some aspects of the present invention may be embodied to have only a single cushion or may of course have more than two cushions. The types of cushions which may be provided are not limited to those illustrated herein, but in accordance with the present invention any other suitable type of cushion may be provided. It should also be understood that the present invention does not require that both upper and lower cribs have fabric strips for lateral stability. For example, it may be considered that a fabric strip for the upper cushion may provide sufficient lateral stability.

In order to inhibit or prevent sliding of either of the mattress 30 and 80 relative to the bedstead, a suitable anti-skid material, illustrated at 29 and 31 respectively, is attached such as by Velcro strips to the mattress cover on the underside of the mattress. The anti-skid material may, for example, be a scrim or webbing with a rubbery coating and may be applied to cover the mid-portion or other suitable portion or portions of the mattress bottom. An example of a suitable anti-skid material is Scoot Gard material sold by Vantage Industries of Atlanta, Ga.

Figure 7:
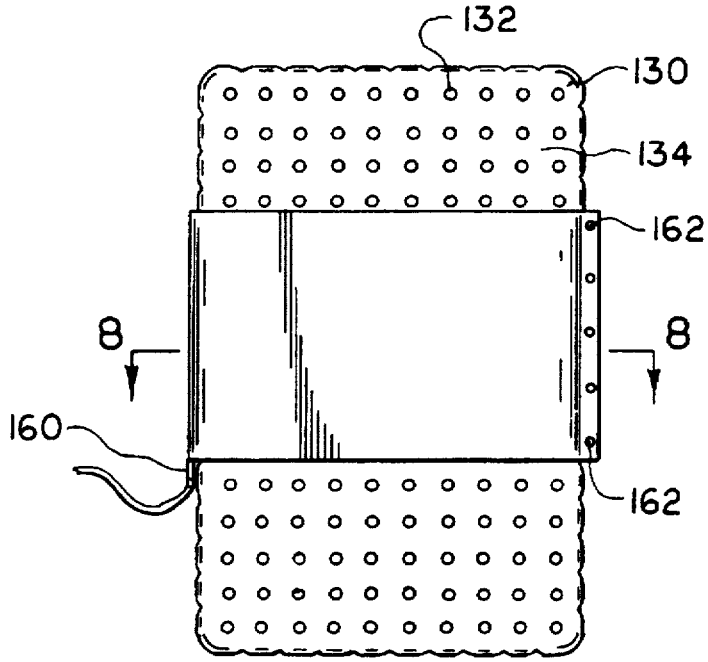
FIG. 7 is a plan view of a pressurizable cushion which includes a sign transmitting and receiving coil assembly in accordance with another embodiment of the present invention.

Referring to FIGS. 7 and 8, there is illustrated at 130 an inflatable cushion which is shown to be similar to cushion 44 but may be any other suitable inflatable cushion such as cushions 46 and 116. The cushion 130 is provided with button welds, illustrated at 132, to prevent ballooning thereof. The cushion 130 has upper and lower surfaces 134 and 136 respectively. Cushion inflation is related to the distance between the upper and lower surfaces.

In order to prevent bottoming-out from occurring and to more precisely regulate the cushion inflation, the cushion 130 is inflated so that the distance between the upper and lower surfaces is a predetermined distance. A transmitter coil 138 and a receiver coil 140 are provided adjacent the upper and lower surfaces 134 and 136 respectively, and the distance therebetween, illustrated at 142, is related to the signal strength of a signal transmitted therebetween. Alternatively, the coil 138 may be provided adjacent the lower surface 136, and the coil 140 provided adjacent the upper surface 134.

Figure 10:
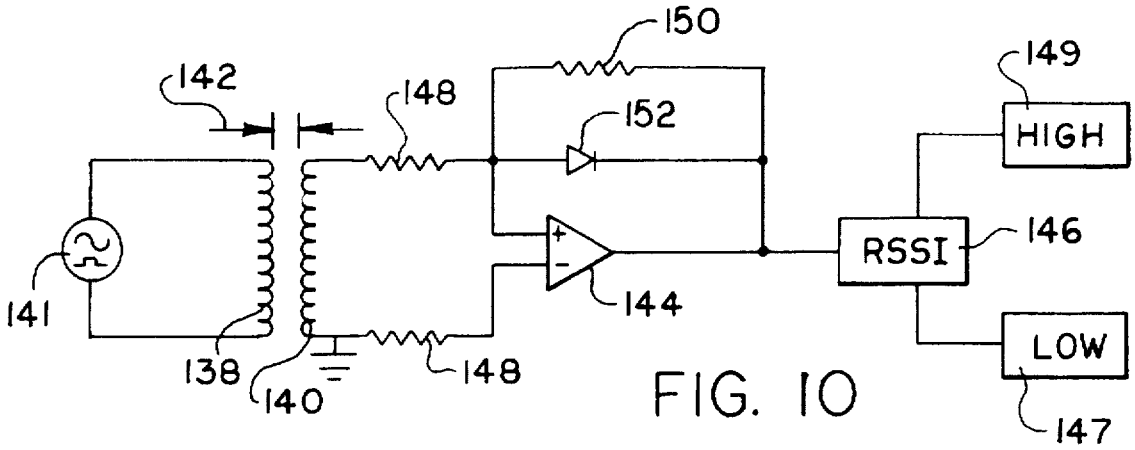
FIG. 10 is a schematic view of the electrical circuit for the coil assembly.

Illustrated at 141 in FIG. 10 is a transmitter for providing to coil 138 a signal which, as illustrated, may be a sinusoidal A.C. signal or may alternatively be a step-change or pulse signal. The received signal on coil 140 is amplified by a suitable amplifier 144, and the amplified signal sent to a suitable received signal strength indicator (RSSI), illustrated at 146, where a measure of signal strength is provided, in accordance with principles commonly known to those of ordinary skill in the art to which this invention pertains, which is suitably translated into a measure of distance 142 between the coils, which thus indicates whether the cushion is suitably inflated. A pair of resisters 148 are in series with the amplifier 144, and a resister 150 and diode 152 are in parallel with each other and with the amplifier 144. Illustrated at 160 is a suitably connector for lines to the coils 138 and 140. The coils and associated circuitry comprise what may be called an inductive loft sensor.

The RSSI 146 is suitably connected to a low height alarm, illustrated at 147, set for a predetermined low cushion height indicative of bottoming-out of the cushion due to low inflation pressure. The RSSI 146 is also suitably connected to a high height alarm, illustrated at 149, set to a predetermined high cushion height indicative of the patient being out-of-bed. A matrix or array of transmitting and receiving coil assemblies may be provided over the cushion area to provide position as well as height feedback.

In accordance with the present invention, the coils 138 and 140 are embedded within a flexible structure such as between thin plastic flexible sheets 154 and 156 which are suitably attached to each other such as by heat sealing. The sheets 154 and 156 may be said to comprise a generally rectangular blanket 158 with the coils 138 and 140 embedded in opposite halves of the blanket 158. The coils are spaced apart (in the plane of the unfolded blanket) a distance, illustrated at 131, equal to at least the maximum thickness of the inflated cushion 130. The blanket 158 is applied by folding it about the cushion so that one coil 138 is adjacent the upper surface 134 and the other coil 140 is adjacent the lower surface 136. Snaps, illustrated at 162, spaced along opposite terminal end edges of the blanket 158 or other suitable means are provided for suitably holding the blanket 158 in place on the cushion 130.

Referring to FIGS. 11 and 12, there is illustrated generally at 170 a mattress containing an inflatable cushion 180 which is tiltable to one side, as illustrated in FIGS. 13 and 14, for the purpose of rolling a patient, illustrated at 171, over, placing the patient in a better position for lifting from the mattress, or otherwise moving the patient as needed.

The mattress 170 includes a foam support member 172, which may be similar to member 32, on which rests tilting assembly, illustrated generally at 174, which will be described hereinafter, the tilting assembly 174 disposed generally within and circumscribed about its periphery by a lower crib 176, which may be similar to crib 34. The crib 176 in turn supports an upper crib 178, which may be similar to crib 36, in which is contained the inflatable air cell or cushion 180, which may be similar to cushion 46 or any other suitable inflatable cushion.

The tilting assembly 174 comprises two sets of bladders, each set of bladders including an upper and a lower inflatable bladder 182 and 184 respectively the width of each of which being slightly less than half of the width of cushion 180. One set of the bladders 182 and 184 underlies the left side portion of the cushion 180, and the other set of bladders 182 and 184 underlies the right side portion thereof. The upper bladders 182 may be any suitable inflatable bladders and have button welds, illustrated at 186, uniformly spaced thereover to prevent ballooning thereof when pressurized. For example, bladders 182 may be similar to cushion 44 and similarly includes inflation means (not shown). The foot end portions 188 of the lower bladders 184 are tapered over about one-third of the length thereof to allow relatively greater lifting capacity for the head end and central portions supporting the torso of a patient since the torso requires greater lifting capacity than the feet. As seen in FIG. 11, the lower bladder 184 is absent button welds or the like so that it may desirably balloon when pressurized to lift the corresponding side of the cushion 180 as needed. Otherwise, bladder 184 may be similar to cushion 44 or any other suitable cushion and similarly includes inflation means (not shown). A fabric strip 190, which may be similar to fabric strip 70, bridges across and is adhesively or otherwise suitably attached to the upper surface of crib 178 for lateral stability. The cribs 176 and 178 and support member 172 are adhesively or otherwise suitably attached, and the assembly including the tilting assembly 174 and cushion 180 are enclosed within a zippered mattress cover 175 similarly as illustrated in FIGS. 2 and 5.

FIG. 12 illustrates the mattress 170 with the cushion 180 in a level condition for the patient 171 to lie normally thereon. In this condition, the cushion 180 and both upper bladders 182 are fully inflated, and the lower bladders 184 are uninflated. The upper bladders 182 together may be said to be equivalent to a lower cushion.

FIG. 13 illustrates tilting of the cushion 180 to about a 15 degree angle to one side by deflating the left side upper bladder 182 and by inflating the right side lower bladder 184. As seen in FIG. 13, this lowers the left side of the cushion 180 and raises the right side thereof thereby providing a "trough," illustrated at 192, on the left side to prevent the patient 171 from falling off the mattress. The patient 171 is thus "caught" by the upper crib 178 with the fabric strip 190 providing lateral stability to prevent the crib 178 from bowing outwardly.

FIG. 14 illustrates tilting of the cushion 180 from the position of FIG. 12 to about a 15 degree angle to the other side by deflating the right side upper bladder 182 and by inflating the left side lower bladder 184. This lowers the right side of the cushion 180 and raises the left side thereof thereby providing a "trough" 192 on the right side to prevent the patient from falling off the mattress. The fabric strip 190 again provides lateral stability to prevent the crib from bowing outwardly.

The cushion 180 may of course be tilted to a higher angle than 15 degrees. For example, the cushion 180 may be tilted to an angle of perhaps about 45 degrees by further inflation of the corresponding lower bladder 184, allowing ballooning thereof so that it approaches a tubular shape, and the width of the fabric strip 190 is selected to suitably accommodate the degree of tilt.

Figure 9:
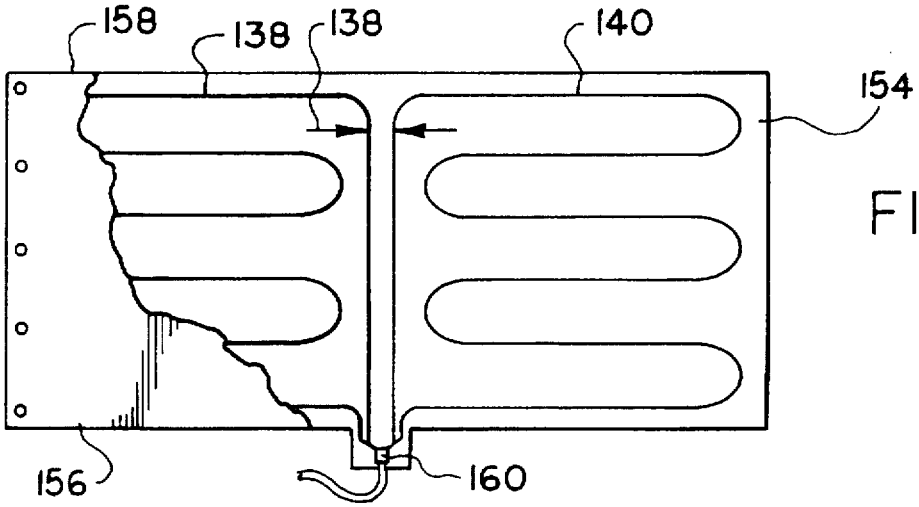
FIG. 9 is a plan view, with a portion broken away for ease of illustration, of the coil assembly.

In accordance with the present invention, the left-side bladders 182 and 184 are sandwiched between a set of transmitter and receiver coils, illustrated schematically at 194 and 196 respectively. The coils are embedded between thin plastic sheets of a blanket 198 and on opposite sides thereof, similarly as illustrated in FIGS. 7 to 9 (except that the free edges are not snapped together since the bladder expansion must be accommodated), so that one coil is adjacent the upper surface of the upper bladder 182 and the other coil is adjacent the lower surface of the lower bladder 184. Likewise, the right-side bladders 182 and 184 are sandwiched between another set of transmitter and receiver coils 194 and 196 respectively and embedded in another blanket 198. The positions of the coils 194 and 196 may of course be interchanged. The coils 194 and 196 may be wired as illustrated in the circuit of FIG. 10 to provide a measure related to the distance therebetween. The blankets 198 are suitably connected along their longitudinal centerlines or foldlines to a junction or connector 200 from which lines are suitably led through cable 202 from the coils to the transmitter 141, amplifier 144, etc. and finally to the received signal strength indicator 146, in accordance with principles commonly known to those of ordinary skill in the art to which this invention pertains.

As the bladders on one side are inflated or deflated, the distance between the coils over the bladder width will vary from the smallest distance near the junction 200 to the greatest distance near the edges of the blanket. As the average distance therebetween increases, the signal strength will proportionately increase so that the angle of tilt may be determined from the signal strength in accordance with principles commonly known to those of ordinary skill in the art to which this invention pertains. Alternatively, the coils may be positioned at finite distances from junction 200 so that the distance therebetween may be determined by measuring signal strength and mathematically translated into angle of tilt. If desired, a hand-held probe (not shown) may be provided to monitor the operation of the inductive loft sensor to tilt a cushion from a nurse's station or the like.

Referring to FIGS. 23 and 24, there is illustrated generally at 350 an alternative embodiment of a lifting and height measuring assembly which may be manufactured inexpensively as a unit to underlie both sides of a cushion within a mattress. The assembly 350 includes right and left side upper bladders 352, which may be similar to bladders 182, and right and left side lower bladders 354, which may be similar to bladders 184. A single chamber having a width equal to the overall width of both bladders 352 is initially formed from upper and lower layers, and the two bladders 352 are formed by a heat weld, illustrated at 356, along the longitudinal centerline. The bladders 354 are similarly formed and attached to bladders 352 by means of the heat weld 356. Transmitter and receiver coils 358 and 360 respectively, which may be similar to coils 194 and 196 respectively, are suitably provided along the upper faces of the upper bladders 352 and the lower faces of the lower bladders 354, the coils of the right-side bladders being independent of the coils of the left-side bladders. As previously discussed, the transmitter and receiver coil positions may be reversed, and the bladders 182 and 184 have suitable inflation means (not shown). The coils 358 and 360 are contained within individual envelopes, illustrated at 362, which are also welded to the assembly 350 at the weld 356. The envelopes have zip-lock openings (not shown) along their outer edges, illustrated at 364, for insertion of the coils. The edges 364 may, if needed, be held adjacent the respective bladder faces by Velcro fasteners.

Placement of the pump 59 for mattress 30 at a location away from the mattress 30 may result in the hose 65 and any other lines from the pump to the mattress being in the way of persons moving about the room. However, if the pump is placed within the mattress, i.e., within the space circumscribed by the cribs 34 and 36 so that it is enclosed by the cribs, heat may undesirably build-up within the mattress due to inability of the heat to escape. Referring to FIGS. 15, 16, and 17, in order to place the pump so that air pressurization lines are out of the way of people moving about the room without such heat build-up in the mattress from occurring, in accordance with the present invention the pump 59 is positioned to face exteriorly of the cribs 34 and 36 and adjacent exteriorly facing surfaces, illustrated at 35, thereof. In order to allow the pump 59 to be contained within the boundaries of the mattress so that it may unobtrusively be "within" the mattress, the pump 59 is mounted within a notch, illustrated at 63, formed by a cut-out in a lower corner of the foot portion of the crib support structure. The notch 63 is suitably sized to the dimensions of the pump 59. Thus, portions of members 38 and 42 of the lower crib 34 as well as a corresponding portion of support member 32 are removed to provide the notch. The pump is suitably attached to the foam crib structure such as, for example, by a pair of webbing straps 69. Each of the straps 69 extends under and along an outwardly facing side of the pump and is suitably attached at its ends to the support member 32 and the upper crib 36 respectively by suitable means such as snaps, illustrated at 71. The mattress cover 48 is suitably tucked within the notch 63 and suitably bonded to surfaces 35 thereof. Thus, the pump 59 is disposed flush with the crib structure yet faces exteriorly to allow heat to dissipate or escape, as illustrated at 73, as well as being more easily accessible and thereby user friendly.

A mattress cover flap 77, having Velcro attachment strips 75 which attachingly mate with similar Velcro attachment strips 53 on the crib structure, is provided to cover the area of the air inlet 56 when the pump hose 65 is not connected thereto. If desired, the flap length may be extended to the corner of the mattress where the pump is located.

If desired, an internal hose, illustrated at 78 in phantom lines, may be provided to connect the pump 59 to air inlet 56. This allows the mattress cover 48 to be more suitably fitted to completely cover and thus "hide" the pump. If desired, the power line containing plug 61 may be routed to be within a groove in the under-surface of the pump.

Figure 18:
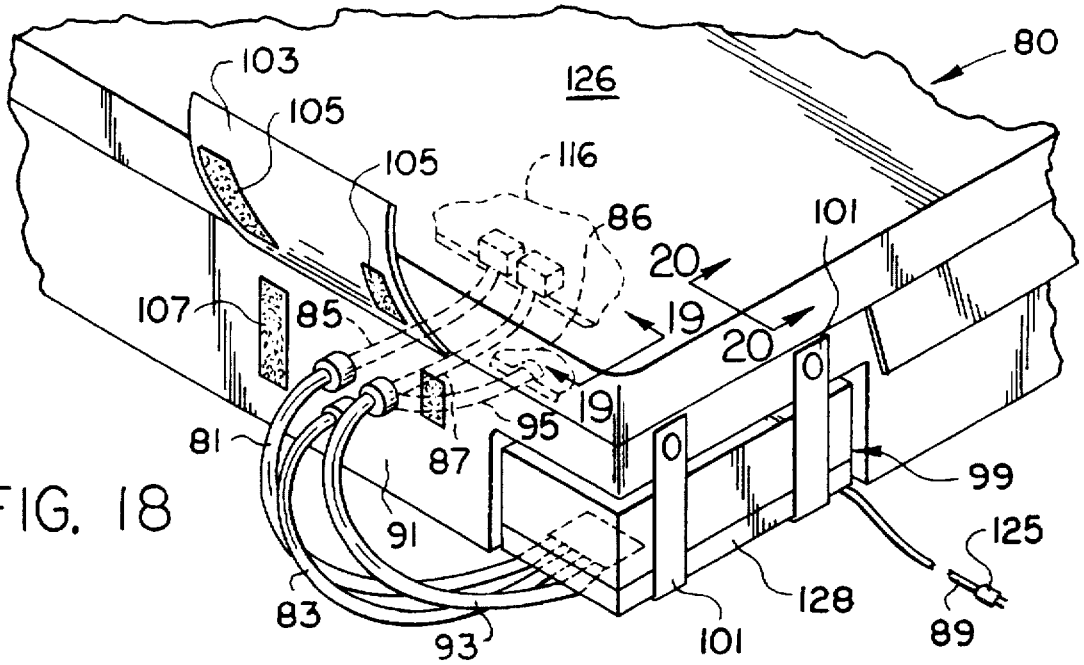
FIG. 18 is a view similar to that of FIG. 15 of a portion of the mattress of FIG. 4 and illustrating installation of an air pump accordance with another embodiment of the present invention.
Figure 19:
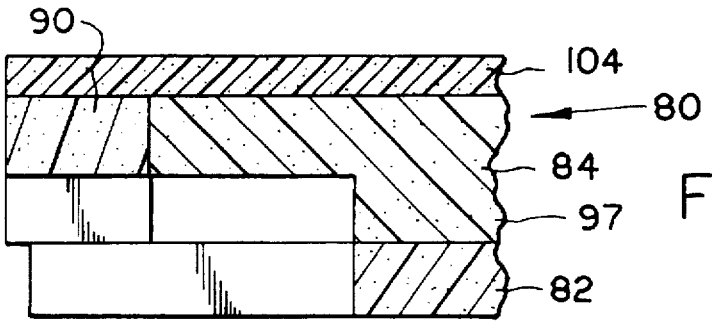
FIG. 19 is a partial sectional view of the mattress portion of FIG. 18 taken along lines 19—19 thereof with the air pump removed for ease of illustration.
Figure 20:
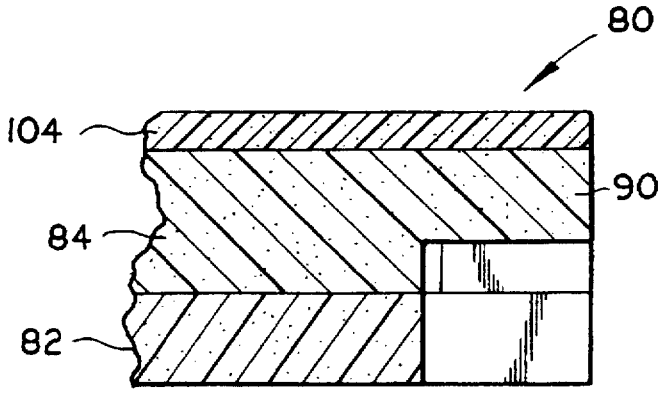
FIG. 20 is a partial sectional view of the mattress portion of FIG. 18 taken along lines 20—20 thereof with the air pump removed for ease of illustration.

Referring to FIGS. 18, 19, and 20, there is illustrated the assembly of pump 128 in a notch, illustrated at 99, in a lower corner of the foot portion of mattress 80. A portion of the member 82 and approximately the lower halves of portions of members 90 and 97 of the crib 84 are cut out to provide room for the pump 128 to fit with faces thereof generally co-planar with surfaces of the crib structure. The pump 128 is similarly attached to the crib structure with straps 101, and the mattress cover 126 is suitably tucked into notch 99 as discussed for mattress 30 and includes a flap 103 with Velcro attachment strips 105 and 107 which may be similar to flap 77 and strips 75 and 53 respectively. If desired, the pump 128 may be connected internally of the mattress to air inlets to the cushions 86 and 116, similarly as described with reference to hose 78 for mattress 30, and the mattress cover 126 fitted to completely enclose and thus "hide" the pump 128.

Figure 21:
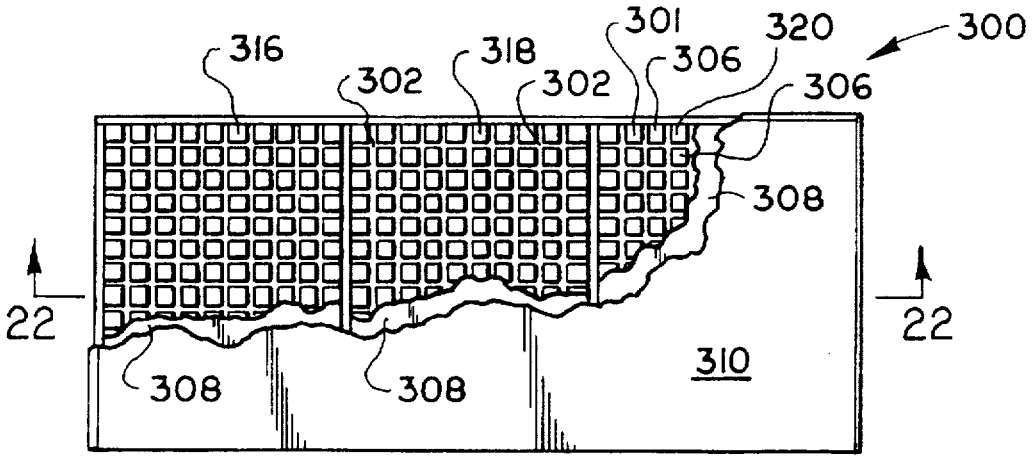
FIG. 21 is a plan view with portions removed for ease of illustration of a foam mattress in accordance with an alternative embodiment of the present invention.
Figure 22:
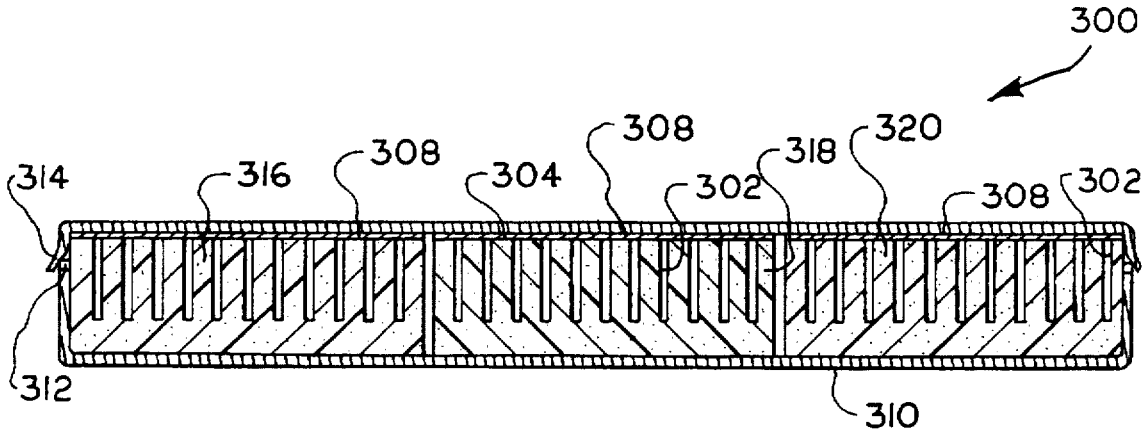
FIG. 22 is a sectional view taken along lines 22—22 of FIG. 21 of the mattress of FIG. 21.

Referring to FIGS. 21 and 22, there is illustrated generally at 300 a mattress composed of foam cushion material 301 to provide pressure reduction, i.e., between about 32 and 140 mm Hg, such as 50 to 60 mm Hg, to patients. The cushion material 301 is characterized by criss-crossing channels, illustrated at 302, in its upper surface 304. The channels 302, which may have a width of perhaps about ¼ inch, have a depth equal to perhaps about 2¾ inch or ⅔ of the cushion depth. The criss-crossing channels 302 define individual cubed support portions 306 for supporting body portions individually without hanging up on adjacent cubed portions.

It has been found that sections of a foam mattress having individual cubed support portions wear out faster than other sections. For example, a section which normally supports a person's upper back may wear out faster than a section which normally only supports a person's feet. In order to extend the life of the mattress 300, in accordance with the present invention the cushion material 301 comprises at least two such as three identical interchangeable sections 316, 318, and 320, one at the head end, another at the foot end, and the third being between the other two. Periodically, the sections 316, 318, and 320 are desirably interchanged so that a section receiving proportionately lesser wear may receive proportionately greater wear.

A soft comfort blanket 308 covers the upper surface 304 of each of the cushion sections and is bonded thereto along the peripheral edges thereof, such as by being adhesively attached over a width of perhaps about 3 inches around the perimeter edges of the respective cushion section and at perhaps one or two spots in the middle thereof. The entire assembly is enclosed within a mattress cover 310 having a zipper 312 along perhaps three edges and a flap 314 covering the zipper.

Referring to FIGS. 25, 26, and 27, there is illustrated generally at 400 an inclinable mattress contained within a mattress cover 402. The mattress cover 402 as well as mattress cover 175 is desirably oversized to accommodate the inclining of the mattresses. The mattress 400 includes a support member 404, which may be similar to support member 32, and upper and lower cribs 406 and 408 respectively, which may be similar to cribs 36 and 34 respectively. The cribs 406 and 408 are foam cribs but may alternatively be air cribs or other suitable cribs.

The mattress 400 includes a lower static cell or cushion 410 which may have vent holes (not shown) having a diameter of perhaps about 0.02 inch for providing a constant bleed for pressure equalization. The mattress 400 also includes a pair of side-by-side upper cushions 412 and 413 which may be of an alternating pressure type similar to cushion 116 and which may have holes (not shown) for low air loss. Between the upper and lower cushions is disposed a pair of side-by-side inflatable turning bladders 416 and 418, which may be similar to turning bladders 182. Bladder 416 is disposed under cushion 412, and bladder 418 is disposed under cushion 413. The upper cushions 412 and 413 and the bladders 416 and 418 are suitably heat welded together as illustrated at 415. The cushions and bladders for mattress 400 may be pressurized by a model CL1000 pump, marketed by Gaymar Industries, Inc., or other suitable pump, illustrated schematically at 417. The pump 417 may be contained in a notch in the cribs such as illustrated in FIG. 15.

The upper crib 406 has connected thereto a pair of shoulder and hip cross-strips 420 and 422 respectively, which may be similar to strips 66, for providing lateral stability to the mattress 400. The shoulder strip 420 is shown to run under the turning bladders 416 and 418. The hip strip 422 runs over top of the cushions 412 and 413. In order that the shoulder strip 420 not hinder the turning or tilting process so that an increased turning angle may be obtained while still affording the desired lateral stability, a slack, illustrated at 424, of perhaps about 2 inches is provided in the length of the shoulder strip 420.

It is considered desirable that the person lying on the mattress 400 remain centered as the mattress is inclined. However, thin persons may tend to slide sideways. In order to maintain the person's body alignment, a hip bladder, illustrated at 426 and 428, is provided on each side of the mattress at the location generally of the person's hips and extends over a length of perhaps about 20 inches. The hip bladders 426 and 428, which may be expandable to a diameter of perhaps about 4 inches, are contained within envelopes 430 of non-woven material.

In order to incline the mattress to the right side as seen in FIG. 26, the right cushion 413 is raised at an incline by inflating bladder 418, while the pressure in the left cushion 412 is released to lower the mattress height on the left side. At the same time, the left hip bladder 426 is inflated to maintain the patient body alignment. The mattress may be returned to a level condition by re-inflating the left cushion 412 and releasing the pressure from the right bladder 418 and the hip bladder 426. If it were desired that the mattress be inclined to the left side, the left bladder 416 and the right hip bladder 428 would be inflated and pressure released from the right cushion 413.

It should be understood that, while the invention has been described in detail herein, the invention can be embodied otherwise without departing from the principles thereof, and such other embodiments are meant to come within the scope of the present invention as defined by the appended claims.

What is claimed is:

1. A mattress, which comprises:

a) a crib;

b) a lower support member secured to the crib; and c) a first inflatable cushion surrounded by the crib and comprising side-by-side first and second adjustably inflatable bladders extending substantially along and on opposed sides of a longitudinal axis of the mattress, wherein each of the first and second adjustably inflatable bladders comprises an upper inflatable bladder and a lower inflatable bladder so that an upper surface of the first inflatable cushion is tiltable with respect to a horizontal orientation when one of the upper bladders of one of the first and second adjustably inflatable bladders is inflated while the lower bladder of the other of the first and second adjustably inflatable bladders is deflated.

2. The mattress of claim 1 further comprising means for maintaining body alignment of a person lying on the mattress.

3. The mattress of claim 2 wherein the alignment maintaining means comprises a bladder which is inflatable and positioned to apply pressure to the hip area of the person on an other side of the mattress.

4. The mattress of claim 1 further comprising at least one means for laterally stabilizing the crib.

5. The mattress of claim 4 wherein the crib includes at least one pair of elongate portions extending alongside spaced apart sides of the first inflatable cushion, the lateral stabilizer comprising at least one fabric strip extending between and attached to both of the at least one pair of elongate portions.

6. The mattress of claim 5 wherein the fabric strip has a length which provides slack when the first inflatable cushion is not inclined.

7. The mattress of claim 5 wherein the fabric strip extends intermediate the first inflatable cushion and a second inflatable cushion.

8. The mattress of claim 7 wherein the fabric strip has a length which provides slack when the other of the first and second adjustably inflatable bladders is deflated.

9. The mattress of claim 1 further including a second inflatable cushion.

10. The mattress of claim 1 wherein a foot end portion of the first and second adjustably inflatable bladders is tapered toward the longitudinal axis of the mattress.

11. The mattress of claim 1 further including a second inflatable cushion and wherein the first inflatable cushion is intermediate the lower support member and the second inflatable cushion or the second inflatable cushion is intermediate the lower support means and the first inflatable cushion.

12. The mattress of claim 11 wherein the lower most of the first inflatable cushion and the second inflatable cushion comprises vent holds for providing a constant bleed for pressure equalization.

13. A mattress comprising a crib, at least one cushion within the crib, means for inclining the cushion to at least one side of the mattress, and means for maintaining body alignment of a person lying on the mattress, wherein the inclining means comprises side-by-side first and second adjustably inflatable bladders extending substantially along and on opposed sides of a longitudinal axis of the mattress, and wherein each of the first and second adjustably inflatable bladders comprises an upper inflatable bladder and a lower inflatable bladder so that an upper surface of the cushion is inclinable with respect to a horizontal orientation when the upper bladder of one of the first and second adjustably inflatable bladders is inflated while the lower bladder of the other of the first and second adjustably inflatable bladders is deflated.

14. The mattress of claim 13 wherein the alignment maintaining means comprises a bladder which is inflatable and positioned to apply pressure to the hip area of a person on an other side of the mattress.

15. The mattress of claim 13 further comprising at least one means for laterally stabilizing the crib.

16. The mattress of claim 15 wherein the crib includes a pair of elongate portions extending alongside spaced apart sides of the cushion, the lateral stabilizer comprising at least one fabric strip extending between and attached to both of the elongate portions.

17. The mattress of claim 16 wherein the fabric strip has a length which provides slack when the cushion is not inclined.

18. A pressurizable mattress adapted to be received within a mattress cover, the mattress comprising at least one inflatable cushion having a pair of sides, a crib within which the cushion is received, the crib including a pair of elongate portions extending alongside spaced apart sides of the cushion, and at least one means for laterally stabilizing the crib, the lateral stabilizer comprising at least one fabric strip extending between and attached to both of the elongate portions, the fabric strip being different from any mattress cover in which the mattress is received, wherein the inflatable cushion comprises side-by-side first and second adjustably inflatable bladders extending substantially along and on opposed sides of a longitudinal axis of the mattress, and wherein each of the first and second adjustably inflatable bladders comprises an upper inflatable bladder and a lower inflatable bladder so that an upper surface of the cushion is tiltable with respect to a horizontal orientation when the upper bladder of one of the first and second adjustably inflatable bladders is inflated while the lower bladder of the other of the first and second adjustably inflatable bladders is deflated.

19. The pressurizable mattress of claim 18 wherein the fabric strip has a length which provides slack.

20. The pressurizable mattress of claim 18 wherein the fabric strip cut-out portions that correspond to at least one of a hip, a shoulder and a feet area of a person's body which is subject to frequent pressure ulcers.

21. In a mattress including a crib and at least one cushion within the crib means for lifting at least one side portion of the cushion for inclining the cushion at an angle, and means for determining the angle at which the cushion is inclined, wherein the lifting means comprises side-by-side first and second adjustably inflatable bladders extending substantially along and on opposed sides of a longitudinal axis of the mattress, and wherein each of the first and second adjustably inflatable bladders comprises an upper inflatable bladder and a lower inflatable bladder so that an upper surface of the cushion is liftable with respect to a horizontal orientation when the upper bladder of one of the first and second adjustably inflatable bladders is inflated while the lower bladder of the other of the first and second adjustably inflatable bladders is deflated.

22. The mattress of claim 21 wherein the angle determining means includes a signal transmitting coil positioned adjacent to one of an upper and a lower surfaces of the cushion, a signal receiving coil positioned adjacent to an other of the upper and the lower surfaces of the cushion, and means for measuring signal strength at the signal receiving coil when a signal is transmitted thereto from the signal transmitting coil.

23. The mattress of claim 21 wherein the crib is composed of a foam material and includes a pair of elongate portions extending alongside spaced apart side of the cushion, and at least one means for laterally stabilizing the crib, the lateral stabilizer comprising at least one fabric strip extending between and attached to both of the elongate portions.

24. Apparatus for determining a distance between top and bottom surfaces of an inflated cushion comprising a blanket adapted to be folded so that a first portion thereof engages a top surface of the cushion and a second portion thereof engages a bottom surface of the cushion, a signal transmitting coil in one of the blanket portions, a signal receiving coil in an other of the blanket portions, and means for measuring signal strength at the signal receiving coil when a signal is transmitted thereto from the signal transmitting coil, wherein the cushion comprises side-by-side first and second adjustably inflatable bladders extending substantially along and on opposed sides of a longitudinal axis of the mattress, and wherein each of the first and second adjustably inflatable bladders comprises an upper inflatable bladder and a lower inflatable bladder so that an upper surface of the cushion is tiltable with respect to a horizontal orientation when the upper bladder of one of the first and second adjustably inflatable bladders is inflated while the lower bladder of the other of the first and second adjustably inflatable bladders is deflated.

* * * * *